US005810438A

United States Patent [19]

Newhouse

[11] Patent Number: 5,810,438

[45] Date of Patent: Sep. 22, 1998

[54] ONE PIECE MOLDED SEATING STRUCTURE

[75] Inventor: Thomas J. Newhouse, Grand Rapids, Mich.

[73] Assignee: Herman Miller, Inc., Zeeland, Mich.

[21] Appl. No.: 799,866

[22] Filed: Feb. 14, 1997

Related U.S. Application Data

[63] Continuation of Ser. No. 259,043, Jun. 13, 1994, abandoned.

[51] Int. Cl.[6] ..... A47C 3/12; A47C 7/02

[52] U.S. Cl. ..... 297/286; 297/411.4; 297/411.41; 297/411.44; 297/290; 297/452.15; 297/452.65

[58] Field of Search ..... 297/452.14, 457.15, 297/452.65, 440.22, 411.44, 411.4, 411.41, 411.45, 285, 286, 290, 188.14, 188.15, 188.16, 188.17, DIG. 2

[56] References Cited

U.S. PATENT DOCUMENTS

| | | | |
|---|---|---|---|
| 2,541,835 | 2/1951 | Saarinen . | |
| 2,731,078 | 1/1956 | Cadman et al. | 155/191 |
| 2,808,875 | 10/1957 | Bargen | 155/178 |
| 2,993,733 | 7/1961 | Pinkham . | |
| 3,027,195 | 3/1962 | Nelson et al. . | |
| 3,111,344 | 11/1963 | Hoven et al. . | |
| 3,201,172 | 8/1965 | Bliss . | |
| 3,441,310 | 4/1969 | Gale . | |
| 3,574,400 | 4/1971 | Day . | |
| 3,604,749 | 9/1971 | Parmett . | |
| 3,628,832 | 12/1971 | Jennings . | |
| 3,669,496 | 6/1972 | Chisholm | 297/452.15 |
| 3,756,656 | 9/1973 | Wieck . | |
| 3,847,433 | 11/1974 | Actunet et al. | 297/411.4 |
| 3,873,155 | 3/1975 | Barecki | 297/440.22 |
| 3,883,176 | 5/1975 | Morton | 297/457 |
| 3,982,785 | 9/1976 | Ambasz | 297/239 X |
| 4,032,190 | 6/1977 | Müller-Deisig et al. | 297/353 |
| 4,084,850 | 4/1978 | Ambasz | 297/248 X |
| 4,088,367 | 5/1978 | Atkinson | 297/452.144 |
| 4,131,315 | 12/1978 | Vogtherr . | |
| 4,262,871 | 4/1981 | Kolk et al. | 248/188.7 |
| 4,418,958 | 12/1983 | Watkin | 297/457 |
| 4,451,085 | 5/1984 | Franck et al. | 297/285 |
| 4,502,731 | 3/1985 | Snider | 297/452 |
| 4,529,247 | 7/1985 | Stumpf et al. | 297/301 |
| 4,555,140 | 11/1985 | Nemeto | 297/452.65 |
| 4,557,521 | 12/1985 | Lange | 297/285 |
| 4,609,225 | 9/1986 | Loucks . | |
| 4,647,109 | 3/1987 | Christophersen et al. | 297/457 |
| 4,744,603 | 5/1988 | Knoblock | 297/457 |
| 4,856,845 | 8/1989 | Massonett . | |
| 4,856,846 | 8/1989 | Lohmeyer | 297/452.15 |
| 4,889,385 | 12/1989 | Chadwick et al. | 297/304 |
| 4,892,356 | 1/1990 | Pittman et al. | 297/457 |
| 4,948,547 | 8/1990 | Hendry | 264/500 |
| 4,962,964 | 10/1990 | Snodgrass . | |
| 5,015,166 | 5/1991 | Baxi | 425/149 |
| 5,044,691 | 9/1991 | Guichon . | |
| 5,076,646 | 12/1991 | Matte | 297/457 |
| 5,088,792 | 2/1992 | Guichon . | |
| 5,139,714 | 8/1992 | Hettinga | 24/45.1 |
| 5,411,316 | 5/1995 | Lovegrove et al. | 297/452.15 |
| 5,437,823 | 8/1995 | Hettinga et al. . | |

FOREIGN PATENT DOCUMENTS

| | | |
|---|---|---|
| 43586 | 3/1985 | Italy . |
| 1-01732 | 10/1991 | Italy . |

OTHER PUBLICATIONS

"Helga . . . The Gentle Approach To Gas Assist Molding" brochure (Copyright 1992).

Italian Brochure "Sedia 'Aria' (B.U.M.): Progetto Chiavi In Mano" (date unknown).

*Primary Examiner*—Peter M. Cuomo
*Assistant Examiner*—Anthony D. Barfield
*Attorney, Agent, or Firm*—Brinks Hofer Gilson & Lione

[57] ABSTRACT

A one piece molded seating structure includes a seat portion, a back portion, and a pair of resilient support members interconnecting opposite side regions of the seat portion to opposite side regions of the back portion. The support members flex when a user leans rearwardly against the back portion to allow rearward tilting of the back portion relative to the seat portion.

30 Claims, 9 Drawing Sheets

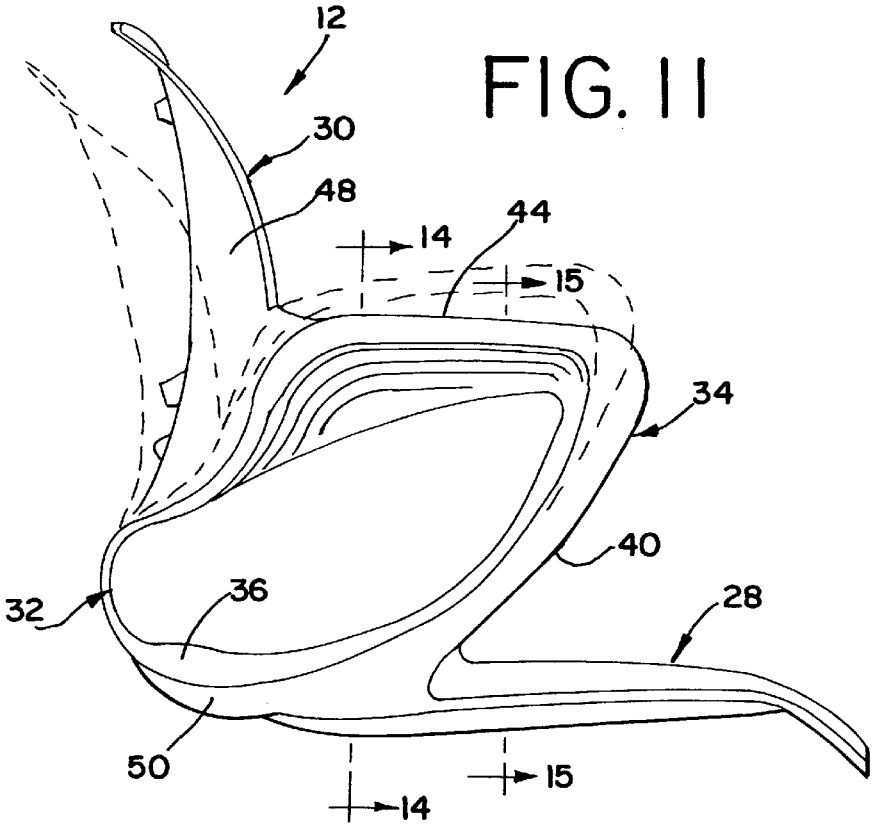
FIG. 11
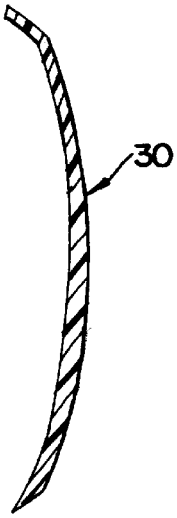
FIG. 12
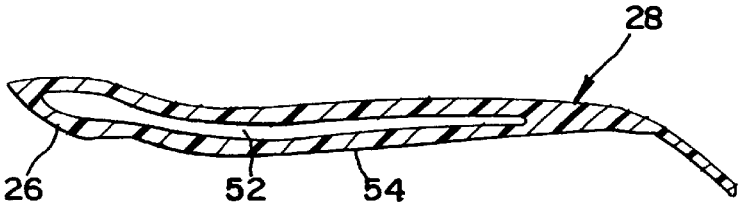

ONE PIECE MOLDED SEATING STRUCTURE

This application is a continuation application of Ser. No. 08/259,043, filed Jun. 13, 1994 now abandoned.

BACKGROUND OF THE INVENTION

The present invention relates generally to seating structures, and more particularly, to a one-piece molded seating structure which allows flexing of a back portion relative to a seat portion. The back portion and seat portion are interconnected by a pair of resilient support members which can be in the form of armrests to provide the desired flexing and structural support.

It is known to provide a one-piece molded seating shell in which a back portion can flex rearwardly relative to a seat portion. For example, U.S. Pat. No. 5,076,646 describes a one-piece molded seating shell including a seat portion and back portion interconnected by a central, narrow integrally formed joint. In order to provide adequate support, the seating shell is formed from a composite polymeric material wherein the joint is thick and has reinforcing fibers extending therein. The construction of the seating shell allows the back portion to flex rearwardly and in torsion. A similar one-piece seating shell is disclosed in U.S. Pat. No. 3,883,176. The seat portion and back portion are connected by a joint which is vertically corrugated and relatively thick.

Although the back portions of these shells flex relative to the seat portions, it is desirable to minimize the flexing of the backrest in torsion. It is also desirable to provide adequate support for heavy users without having to reinforce the joint. However, it has been found difficult to ensure adequate support and at the same time provide the desired resiliency for flexing of the back portion.

Attempts have also been made to provide armrests which flex with the back portion of a seating shell. For example, U.S. Pat. No. 4,557,521 discloses a seating shell wherein plastic armrests are plugged into sockets formed on the spring region of a chair. The corners of the armrests act as spring zones to permit a parallelogram movement of the armrests when the back portion is flexed rearwardly. Similarly, U.S. Pat. No. 4,889,385 discloses a pair of flexible armrests which are rotatably mounted to the back and seat. The armrests flex with the backrest in response to a shift in a user's weight.

The present invention is an attempt to provide a low cost chair with the desired structural support and resiliency, and also to provide support for a user's arms.

SUMMARY OF THE INVENTION

Briefly stated, the invention is directed to a one piece molded seating structure defined by a seat portion, a back portion, and a pair of resilient support members. The support members interconnect opposite side regions of the seat portion to opposite side regions of the back portion. Thus, the support members flex when a user leans rearwardly against the back portion to allow rearward tilting of the back portion relative to the seat portion.

In one preferred embodiment of the invention, the seat portion is also interconnected to the back portion by a spring portion which extends between a rear region of the seat portion and a lower region of the back portion. The width of the spring portion is narrower than the width of the seat portion and back portion in order to obtain the desired flexing properties of the back portion. In addition, the support members define armrests which include first legs extending forwardly from the back portion and curved second legs extending upwardly from opposite rear corners of the seat portion. To provide structural support, cavities are formed in the armrests, lateral regions of the back portion, and a rear region of the seat portion. The seating structure is preferably made of an injection molded polymeric material, and the cavities are formed by injecting a compressed liquid such as gas in the polymeric material.

In another aspect of the invention, a pedestal type one-piece molded chair base includes a central hub having a plurality of arms extending radially outward from a top portion thereof. The arms curve downward to terminal ends thereof and have a cavity formed therein to increase the stiffness of the arms in the areas surrounding the cavities.

The present invention provides significant advantages over other seating structures where the back portion flexes relative to the seat portion. For example, significant cost savings can be realized by molding the seating structure in one piece to minimize the number of components. The armrests provide added structure which helps reduce flexing in torsion, yet are also resilient to allow rearward flexing of the back portion. When used, the spring portion also provides the dual function of increasing the stiffness and allowing flexing of the back portion. Moreover, the cavities provide structural integrity in selected regions of the seating structure because the areas of the seating structure surrounding the cavities have a greater stiffness than the remaining areas of the seating structure.

The present invention, together with further objects and advantages, will be best understood by reference to the following detailed description taken in conjunction with the accompanying drawings.

BRIEF DESCRIPTION OF THE DRAWINGS

FIG. 11 is a side view of the seating structure.

FIG. 12 is a cross-sectional view of the seating structure taken along the line 12—12 in FIG. 9.

DETAILED DESCRIPTION OF THE PREFERRED EMBODIMENTS

Figure 2:
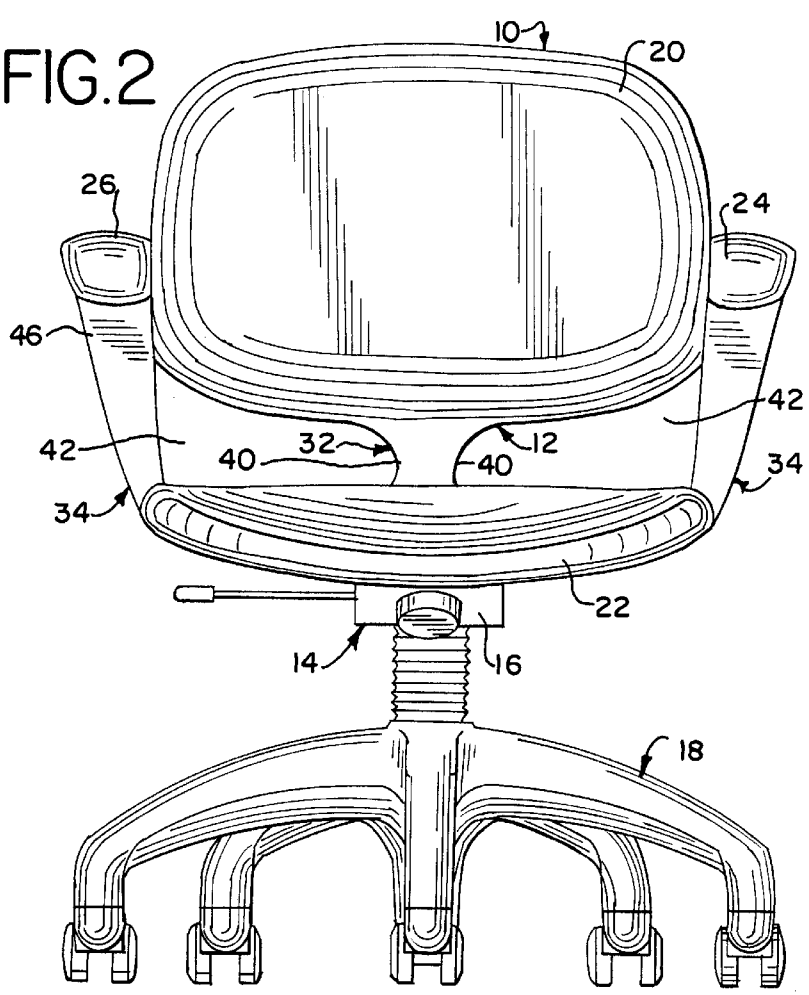
FIG. 2 is a front view of the chair assembly.
Figure 1:
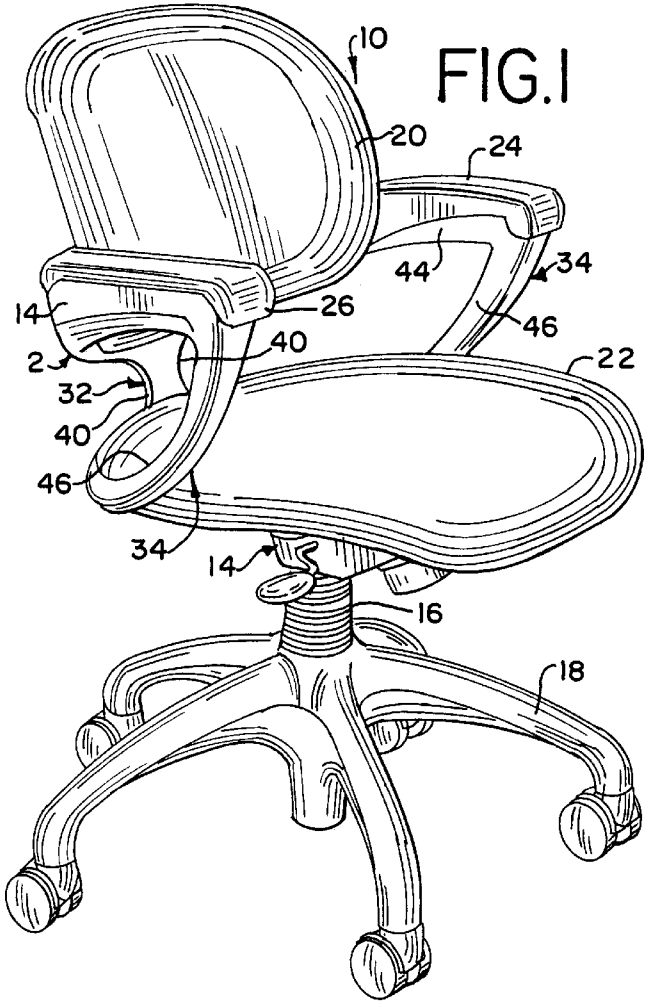
FIG. 1 is a perspective view of a chair assembly including a seating structure mounted on a base, and showing a back cushion, a seat cushion, and armrest cushions attached to the respective portions of the seating structure.
Figure 4:
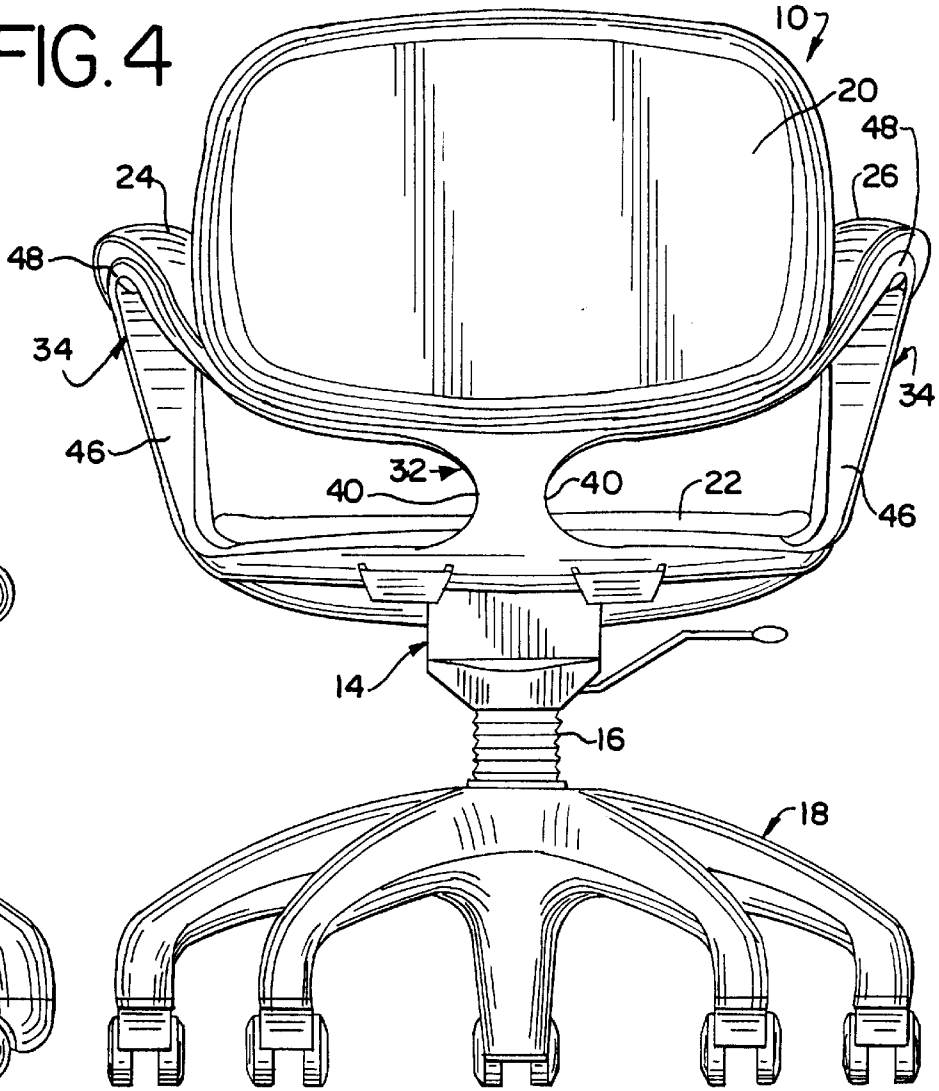
FIG. 4 is a rear view of the chair assembly.
Figure 3:
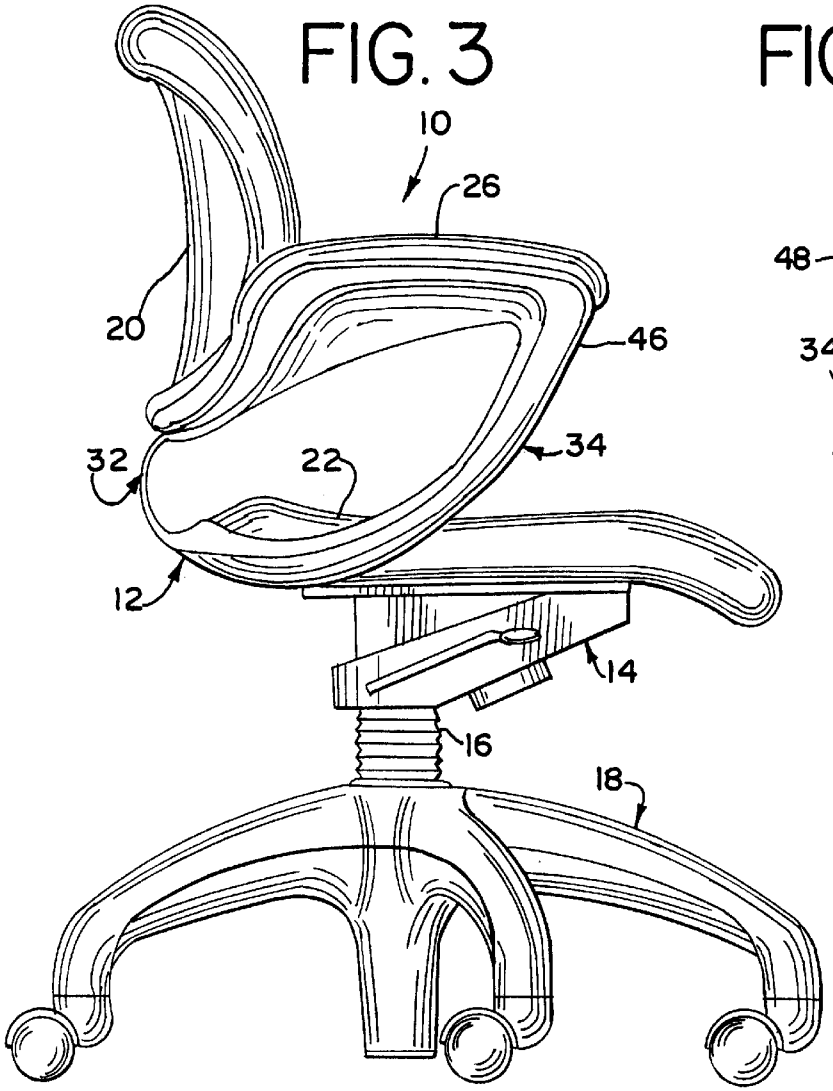
FIG. 3 is a side view of the chair assembly.

Referring to the drawings, FIGS. 1–5 show a chair assembly indicated generally at 10. The chair assembly includes a seating structure 12 attached to a tilt mechanism 14, which is in turn mounted to vertically adjustable support column 16. The support column 16 is mounted to a pedestal-type chair base 18 as will be described in more detail below. A backrest cushion 20, seat cushion 22, and armrests cushions 24, 26 are attached in a conventional fashion to respective portions of the seating structure 12. While the seating structure 12 of the present invention is shown in conjunction with a tilt mechanism 14, a support column 16, and a pedestal-type chair base 18, it is contemplated that other support means having different constructions could be utilized within the scope of the invention. For example, a tilt mechanism need not be provided, and the seating structure could be mounted directly to a stationary chair base without any provision for vertical adjustment.

Figure 6:
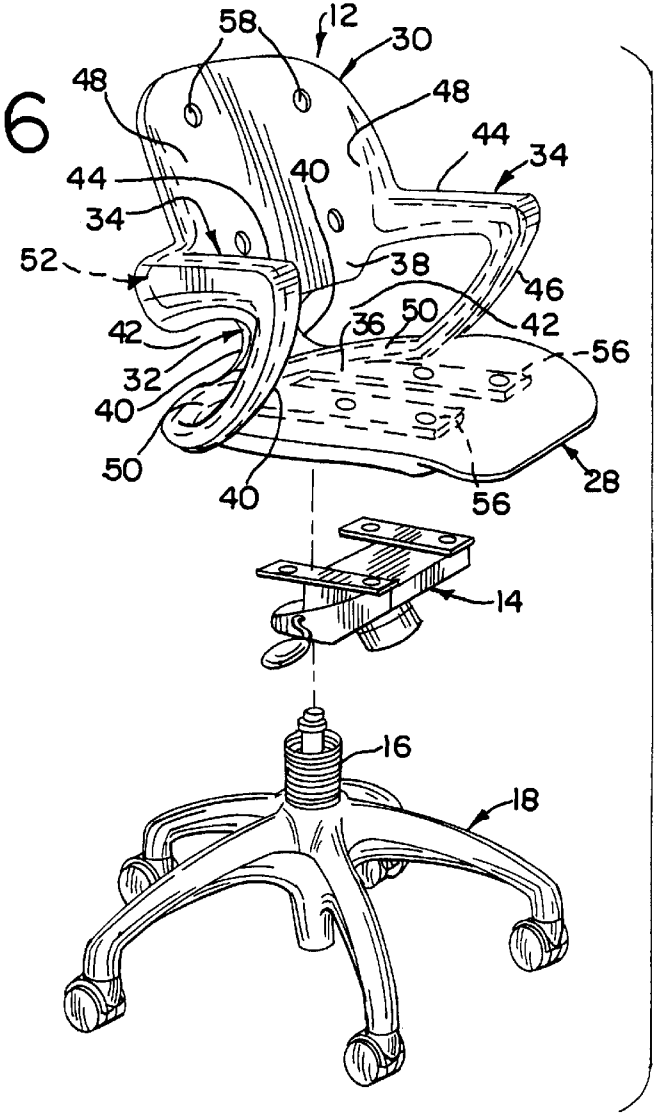
FIG. 6 is an exploded top perspective view of the chair assembly showing the cushions removed from the seating structure for clarity.
Figure 5:
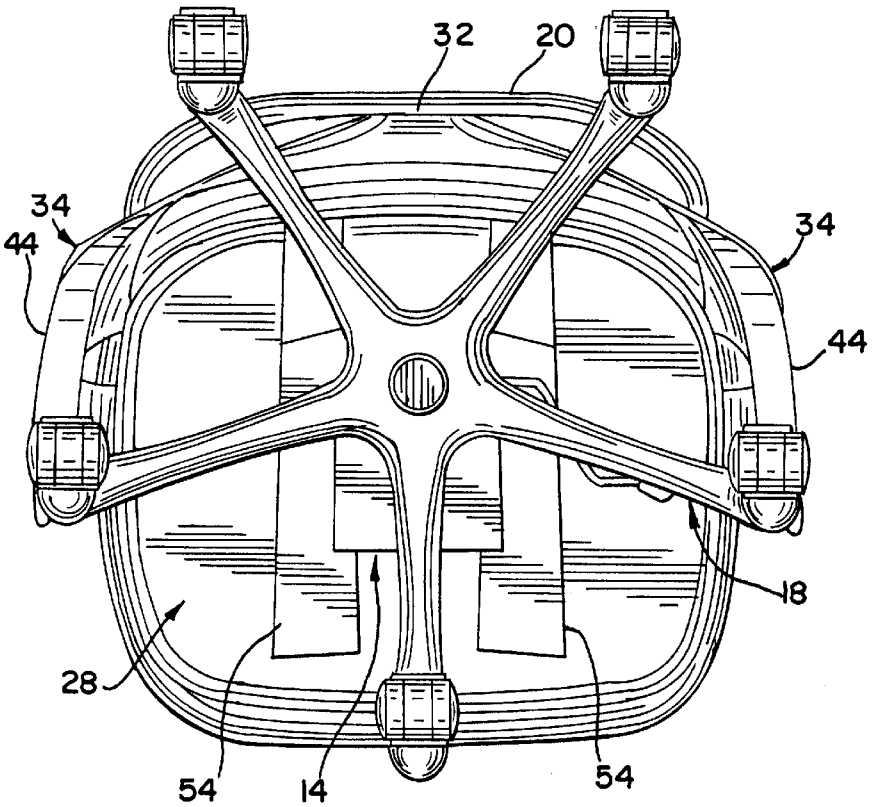
FIG. 5 is a bottom view of the chair assembly.
Figure 7:
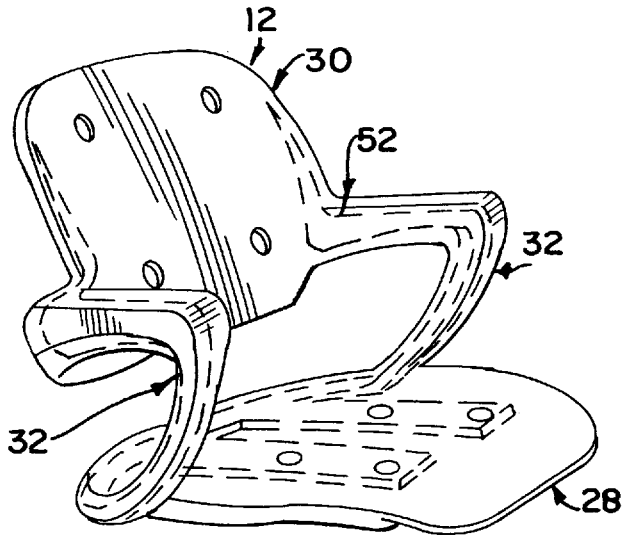
FIG. 7 is a top perspective view of the seating structure showing an alternative embodiment thereof.

In FIGS. 6–11, the seating structure 12 is shown with the cushions 20, 22, 24, and 26 removed. The seating structure 12 is formed as one piece and preferably includes a seat portion 28, a back portion 30, a resilient spring portion 32 and a pair of armrests 34. The spring portion 32 interconnects a rear region 36 of the seat portion 28 and a lower region 38 of the back portion 30. Preferably, the spring portion 32 has curved side edges 40 such that the narrowest region of the spring portion 32 is less than 6 inches. Thus, the spring portion 32 is wide enough to provide structural integrity yet narrow enough to provide inherent springiness. The back portion 30 is therefore allowed to flex rearwardly and downwardly a desired amount to maximize the comfort of a user. In addition, the spring portion 32 may provide upward support which inhibits torquing of the resilient armrests 34. Moreover, the narrowness of the spring portion 32 creates open areas 42 between the seat portion 28 and back portion 30 to increase breathability by allowing air to reach a user's body. Alternatively, the spring portion 32 can be omitted as shown in FIG. 7.

Preferably, the armrests 34 are defined by an upper leg 44 and a lower leg 46. The upper legs 44 extends forwardly from lower lateral regions 48 of the back portion 30, and the lower legs 46 curve upwardly from rear corner regions 50 of the seat portion 28. When the back portion 30 and armrests flex rearwardly as shown in broken lines in FIG. 11, the joints between the armrests 34 and the seat and back portions 28 and 30 are the areas subjected to the greatest stress. Thus, the joints are configured to provide a smooth transition between the armrests 34 and the seat and back portions 28 and 30. In addition, the thickness of the upper legs 44 increases from the juncture of the upper and lower legs 44, 46 to the rear joints of the upper legs 44 to provide additional support.

Thus, the 3-point connection of the spring portion 32 and armrests 34 to the seat and back portions 28 and 30 provides a stabilized structure which adequately supports a heavy user when leaning backward, as well as preventing a torquing or wobbling action of the seating structure 12 when the user moves around in the chair. At the same time, the resilient spring portion 32 and armrests 34 provide an inherent springiness which allows the back portion 30 to flex rearwardly relative to the seat portion 28. This allows the seating structure to be formed from a polymeric material such as polypropylene, without having to use glass or carbon fiber reinforcing additives, or other more expensive engineering plastic resins.

Figure 8:
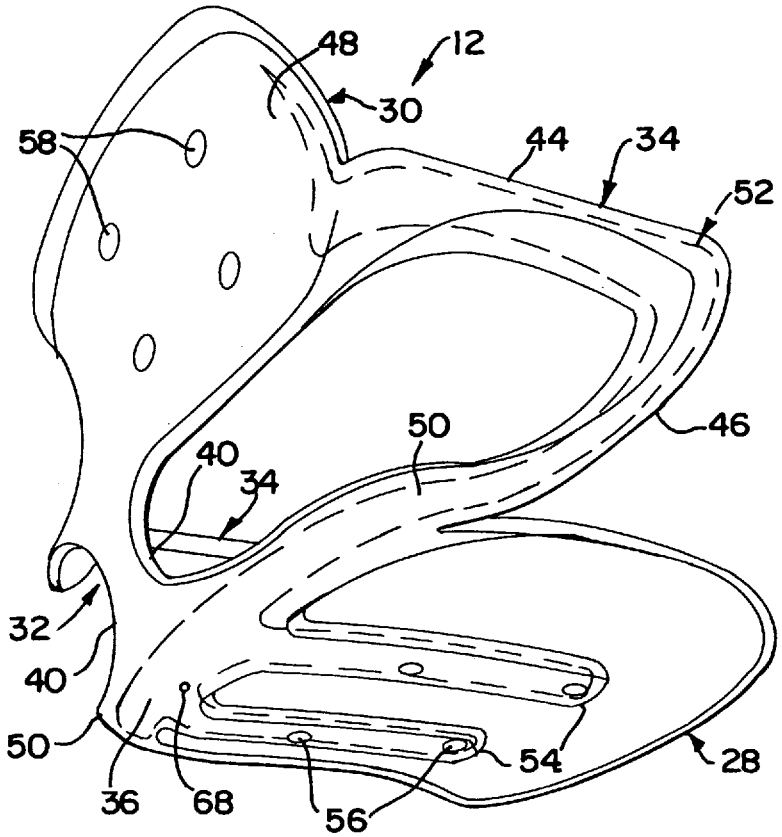
FIG. 8 is a bottom perspective view of the seating structure.
Figure 9:
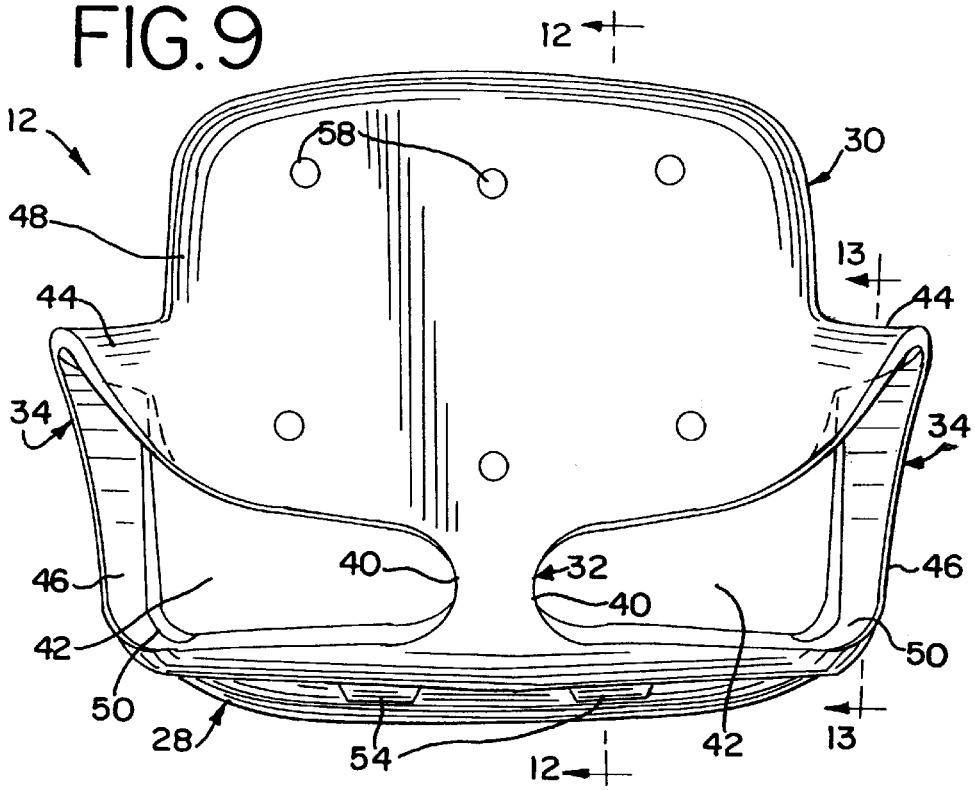
FIG. 9 is a rear view of the seating structure.
Figure 10:
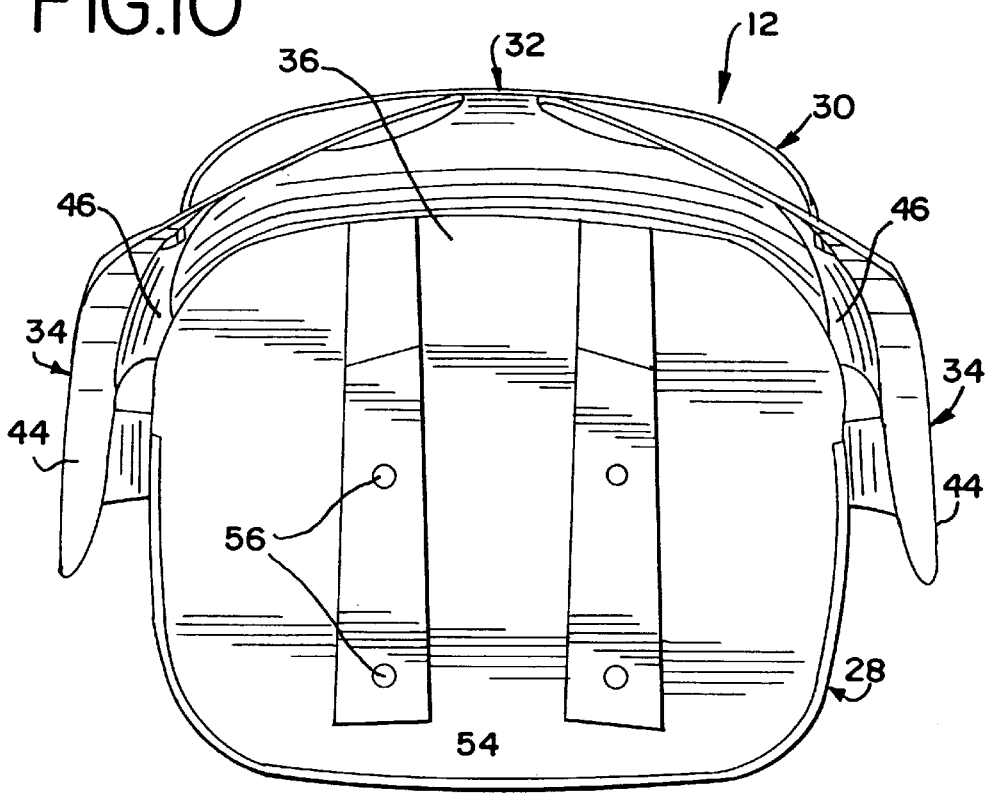
FIG. 10 is a bottom view of the seating structure.
Figure 13:
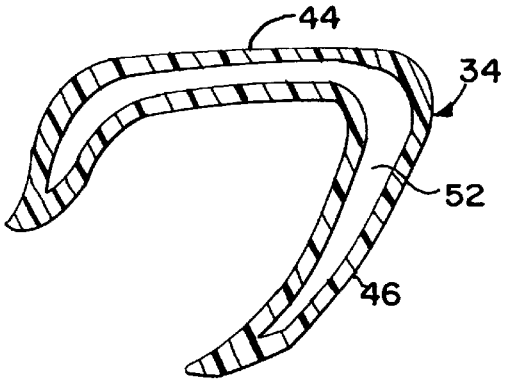
FIG. 13 is a cross-sectional view of the seating structure taken along the line 13—13 in FIG. 9.
Figure 14:
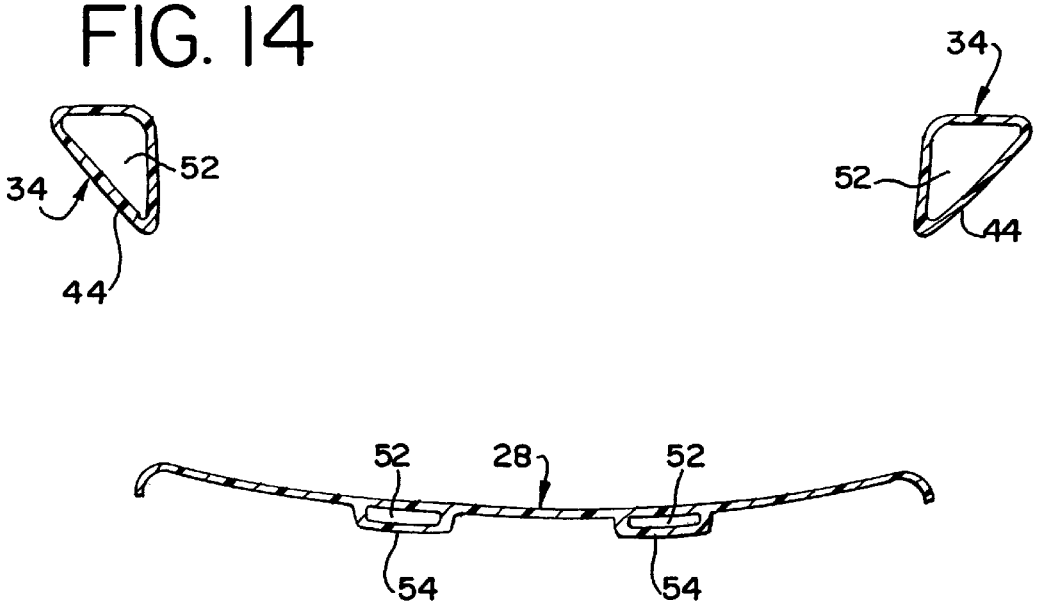
FIG. 14 is a cross-sectional view of the seating structure taken along the line 14—14 in FIG. 11.
Figure 15:
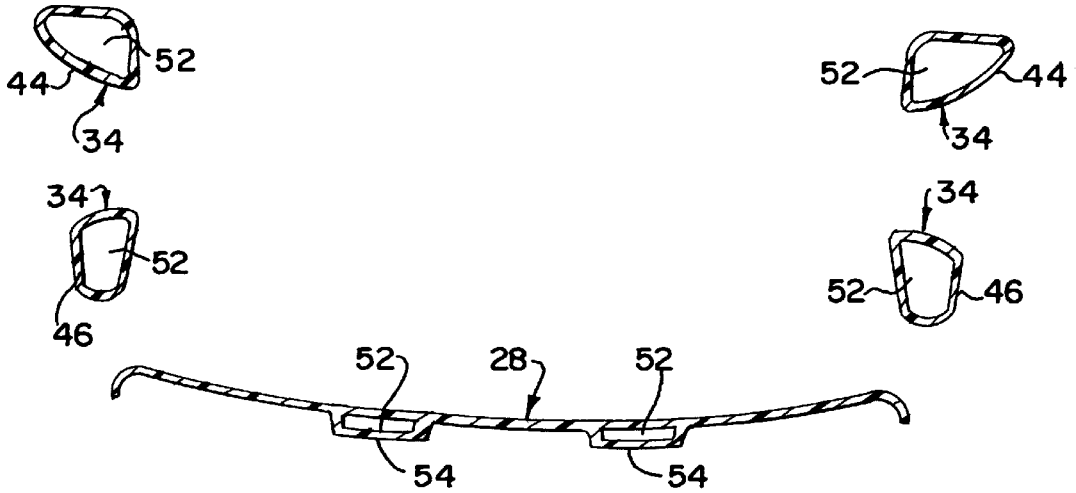
FIG. 15 is a cross-sectional view of the seating structure taken along the line 15—15 in FIG. 11.
Figure 16:
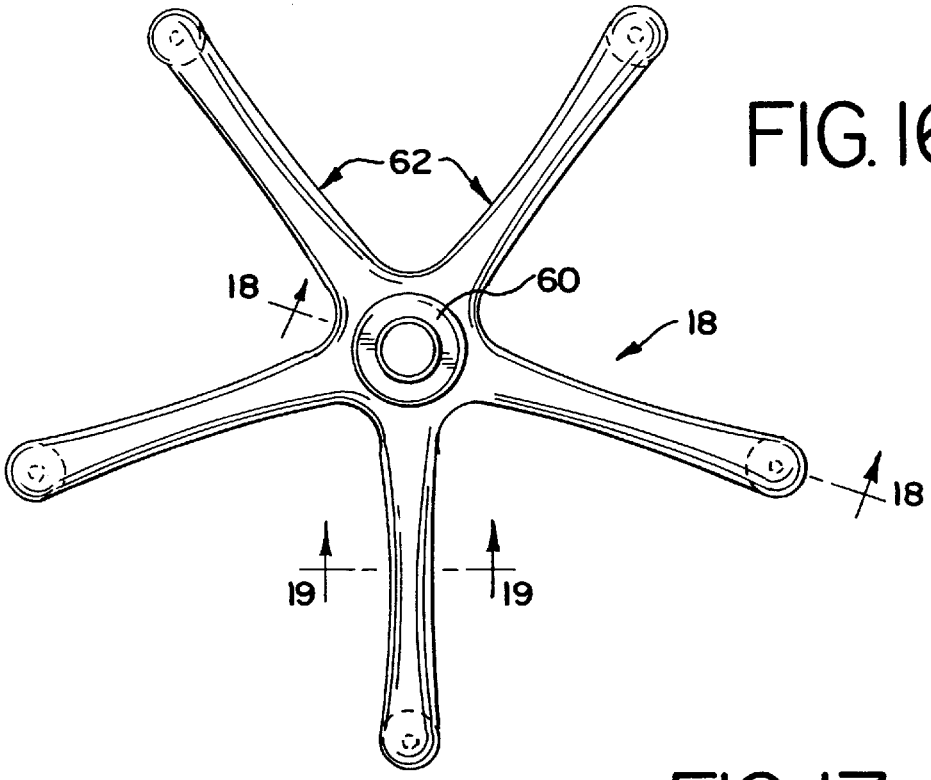
FIG. 16 is a top view of a chair base.
Figure 17:
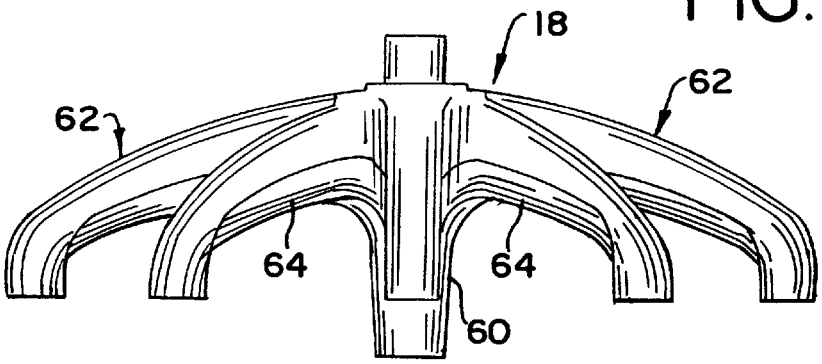
FIG. 17 is a front view of the chair base.
Figure 18:
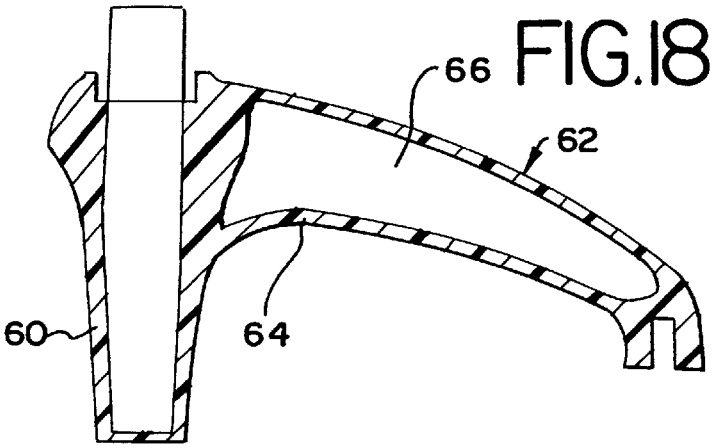
FIG. 18 is a fragmentary cross-sectional view of the chair base taken along the line 18—18 in FIG. 16.
Figure 19:
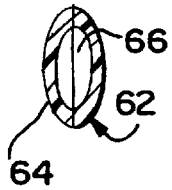
FIG. 19 is a cross-sectional view of one of the arms of the chair base taken along the line 19—19 in FIG. 16.

To provide additional support for the loads imparted by a user, a plurality of hollows or cavities are formed in selected regions of the seating structure 12 in a manner discussed in more detail below. The cavities are formed such that areas of the seating structure 12 surrounding the cavities have a greater stiffness than the remaining areas of the seating structure. Preferably, a single continuous cavity 52 extends through the seating structure 12 as shown in FIGS. 6–8. The cavity 52 extends through both legs 44 and 46 of the armrests 34 and upwardly into the lateral regions 48 of the back portion 30. Preferably, the cavity 52 does not extend through the entire height of the back portion 30 to allow flexing of the upper region of the back portion 30. In addition, the cavity 52 extends laterally through the rear region 26 of the seat portion 28, and forwardly from the rear region 26 through two spaced apart ribs 54 formed on an underside of the seat portion 28. Thus, the portion of the cavity 52 extending through the armrests 34 and back portion 30 provide additional support when a user leans rearwardly. Likewise, the portions of cavity 52 in the seat portion 28 serve to rigidize the seat portion 28 to prevent undesirable flexing of the seat portion as a user shifts his or her weight during normal use of the chair 10.

In addition to increasing the stiffness of the seating structure 12 to support loads imparted by a user, the cavities in the ribs 54 increase the strength of the ribs 54 to allow attachment of the tilt mechanism 14 without damaging the plastic seat portion 28. Moreover, the cavities in the ribs 54 allow a fastener to extend therein to facilitate the mounting of the tilt mechanism 14 to the ribs 54. As shown in FIGS. 6–8 and 10, a plurality of holes 56 are formed in the ribs 54 for receiving the fasteners (not shown). FIGS. 6–9 also show a plurality of holes 58 formed in the back portion 30 for the attachment of the backrest cushion 20 thereto.

FIGS. 16–19 illustrate a preferred embodiment of the chair base 18. The base 18 is a one-piece molded unit including a central hub 60 and a plurality of arms 62 extending radially outwardly and downwardly from a top portion of the hub 60. Preferably, five arms curve downwardly to terminal ends thereof for attachment of associated wheels thereto. The arms 62 can be configured to angle downwardly from the top portion of the hub 60 without being curved. Because the arms 62 extend downwardly from a top portion of the hub 60, a greater vertical beam strength can be achieved by increasing the vertical thickness of the arms 62 adjacent the hub 60 (as shown at 64). In addition, a hollow or cavity 66 is formed in each arm 62 to increase the stiffness of the arms 62 in the areas surrounding the cavities 66. Thus, the necessary strength of the base 18 is obtained by forming cavities in the arms 62 and increasing their beam thickness, which is made possible by the high-profile configuration of the base 18.

The seating structure 12 and the base 18 are preferably made by Hettinga Technologies, Inc. of Des Moines, Iowa in accordance with the injection molding process disclosed in U.S. Pat. No. 5,139,714 to Hettinga, issued Aug. 18, 1992.

In that process, hollows or cavities are formed in selected portions of a plastic article by injecting a low pressure heat-activated gas into the stream of the plastic material. When the plastic material and heat-activated gas enter a mold cavity, the gas expands to exert outward pressure on the plastic material. The plastic material is thereby urged toward the walls of the mold cavity to form the hollows and increase the strength of the plastic article in the area surrounding the hollows. Preferably, the wall thicknesses of the seating structure surrounding the cavities is between about 0.200 and 0.380 inches. Thus, the cavities 52 and 66 in the seating structure 12 and base 18 are formed using this process. In order to mold the seating structure 12 and base 18 as one-piece units, a mold apparatus (not shown) is provided which has cavities corresponding to the shape of the articles. In regard to the seating structure 12, the plastic material and gas are preferably injected through a single gate in the mold apparatus so that the stream of material flows from a navel indicated at 68. Because the gas naturally flows to the areas of the mold cavity having the greatest thickness, the gas flows from the navel 68, forwardly through the ribs 54, laterally through the rear region 36 of the seat portion 28, and upwardly through the armrests 34 and lateral regions 48 of the back portion 30. Thus, the configuration of the seating structure 12 is specifically designed to produce a desired size cavity 52 in desired regions to selectively increase the strength of the seating structure 12 in those regions.

Preferably, the plastic material is a polypropylene compound including a 35% talc and calcium carbonate reinforcing material. Such a polypropylene compound is made by Blue Water Plastics, Inc. and tends to provide a high flex modulus and tensile strength. The polypropylene compound preferably has the following properties:

| Physical Properties | | Typical Values | ASTM Methods |
|---|---|---|---|
| Melt Flow Rate | (g/10 min) | 10 | D-1238 |
| Tensile Strength @ yield (2"/min) | (psi) | 4450 | D-638 |
| Tensile Elongation @ break (2"/min) | (%) | 35.34 | D-638 |
| Flexural Modulus tangent | (kpsi) | 493 | D-790 |
| Flexural Strength | (psi) | 8457 | D-790 |
| Heat Deflection Temp. | (°C.) | | D-648 |
| 66 psi | | N/A | |
| 264 psi | | N/A | |
| Izod Impact Strength, ⅛" notched, 73° F. | (ft-lbs/in) | .85 | D-256 |
| Density | (g/cc) | 1.14 | D-792 |
| Filler Content | (%) | 29 | — |
| Shrinkage | (in/in) | .015 | D-955 |

Figure 21:
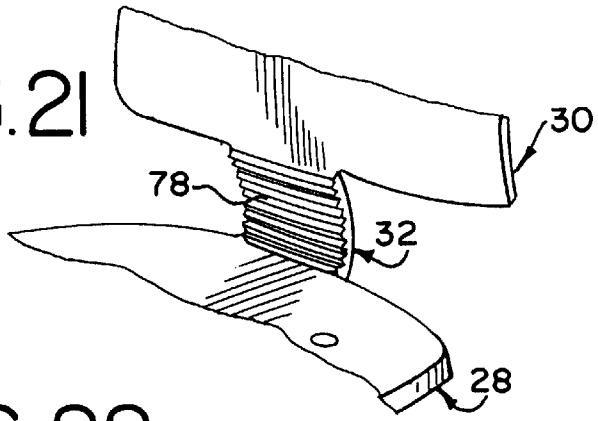
FIG. 21 is a partial perspective view of another alternative embodiment of the spring portion of the seating structure.
Figure 22:
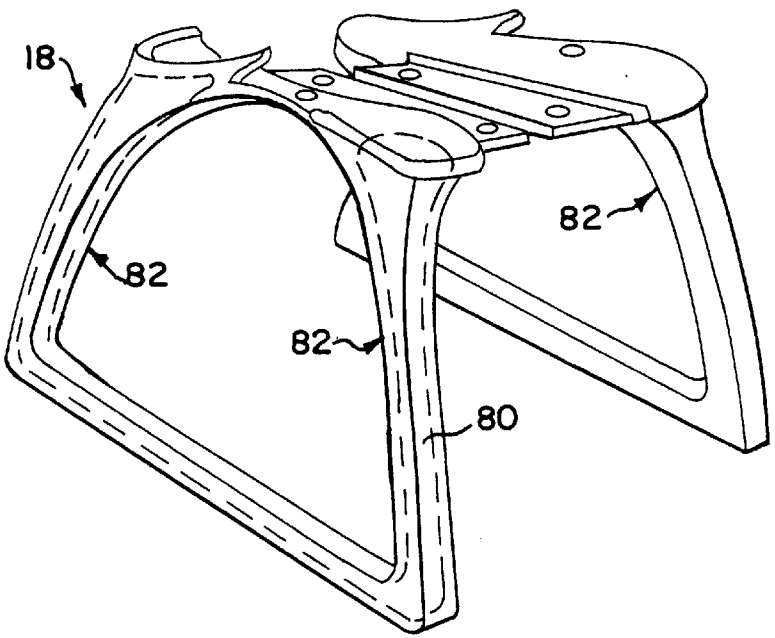
FIG. 22 is a perspective view of an alternative embodiment of the chair base.
Figure 20:
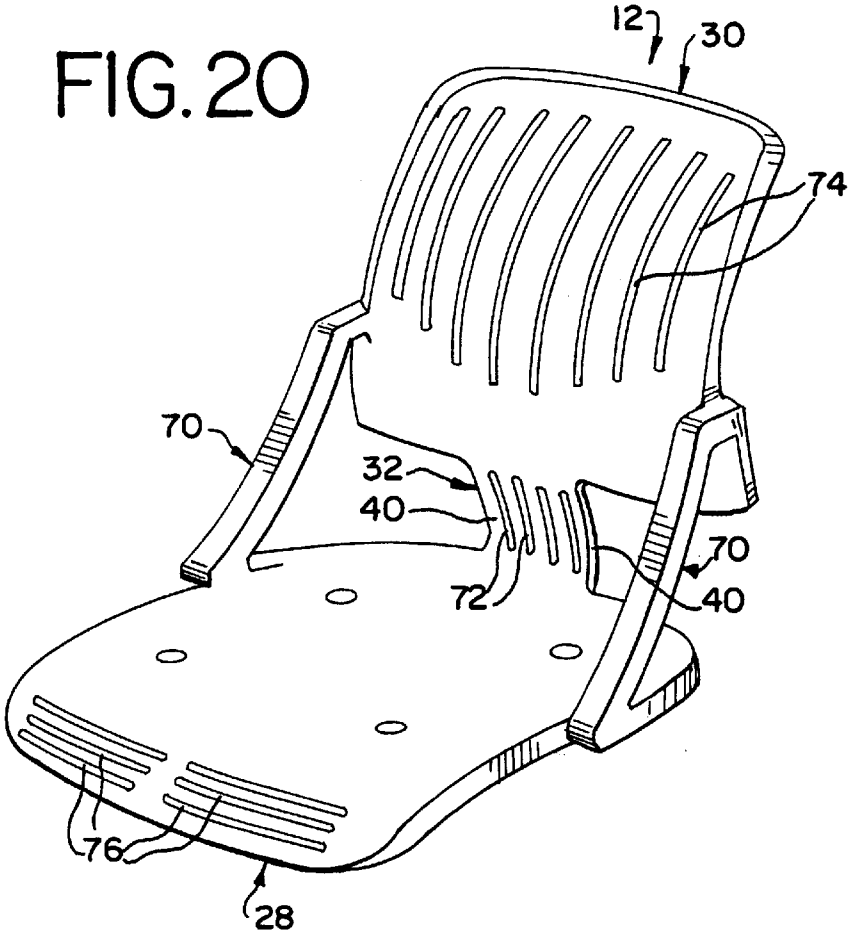
FIG. 20 is a perspective view of an alternative embodiment of the seating structure.

FIGS. 20–22 illustrate several alternative embodiments of the present invention. Since portions of these embodiments are similar to the previously described embodiment, similar parts are represented by the same reference numeral. In FIG. 20, a pair of support arms 70 interconnect the seat portion 28 to the back portion 30. Rather than acting as armrests, the support arms 70 angle downwardly from the back portion 30 to the seat portion 28. In addition, a plurality of parallel, spaced slots 72, 74 and 76 can be formed in the spring portion 32, the back portion 30, and the front region of the seat portion 28. Any of the sets of slots 72, 74, and 76 can be omitted to produce a desired combination of slots in order to provide the desired flexing characteristics of the seating structure 12. Moreover, a plurality of horizontal ribs 78 can be formed on the spring portion 32 of the seating structure 12 as shown in FIG. 21. FIG. 22 illustrates a one-piece molded chair base 18 which is configured as a stationary sled base. The base 18 also has a cavity 80 formed in the legs 82 thereof to increase the strength of the base.

Thus, a low-cost, one-piece "smart" seating structure is provided which provides adequate structural support and desirable flexing properties without the use of multiple components, glass or carbon fiber reinforcing additives, or expensive engineering plastic resins.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

I claim:

1. A one piece molded seating structure comprising:

a seat portion;

a back portion; and a pair of resilient support members interconnecting side regions of the seat portion to side regions of the back portion;

wherein each of said support members has an enclosed cavity, said cavities formed completely internally in said support members so as to be completely hidden from view on all sides of said support members; and wherein said seat portion, said back portion and said support members are integrally formed as a single molded piece of material.

2. The invention of claim 1 wherein said cavities extend continuously upward from the support members into internal side regions of the back portion.

3. The invention of claim 1 wherein said cavities extend continuously from the support members inwardly along a rear internal region of the seat portion.

4. The invention of claim 3 wherein said cavities extend continuously across the entire width of the rear region of the seat portion such that a single continuous enclosed cavity is formed internally in the seating structure.

5. The invention of claim 4 wherein said cavity extends forwardly from said rear internal region of said seat portion internally toward a front region of the seat portion so as to allow a fastener to extend therein for securely attaching the seating structure to a support structure.

6. The invention of claim 1 wherein each of said cavities extends continuously from the support member inwardly along a rear internal region of the seat portion.

7. The invention of claim 1 wherein the seating structure is made of an injection molded polymeric material, and the enclosed cavities are formed internally in the seating structure by injecting a low pressure heat-activated gas in the polymeric material.

8. The invention of claim 1 wherein the support members comprise armrests defined by a first leg extending forwardly from the back portion and a second leg extending upwardly from the seat portion, said enclosed cavity extending continuously internally from said second leg to said first leg.

9. The invention of claim 8 wherein the second legs of the armrests extend upwardly from opposite side rear corner portions of the seat portion.

10. The invention of claim 9 wherein the second legs of the armrest are curved.

11. The invention of claim 8 further comprising cushions attached to the armrests.

12. The invention of claim 1 wherein a lower edge of the back portion is spaced apart from a rear edge of the seat portion so as to form an opening between them.

13. The invention of claim 12 further comprising a resilient spring portion interconnecting said rear edge of the seat portion to said lower edge of the back portion.

14. The invention of claim 13 wherein the width of the spring portion is narrower than the width of the seat portion and the back portion.

15. The invention of claim 1 further comprising cushions attached to the seat and back portions.

16. A one piece molded seating structure comprising:

a seat portion;

a back portion; and a pair of resilient support members interconnecting side regions of the seat portion to side regions of the back portion, each of said support members having a tubular cross-section with a single enclosed hollow formed completely internally therein, said support members having a smooth unbroken exterior surface formed around an entire periphery of the support members whereby the support members are provided with an external appearance of being solid throughout their respective cross-sections; and wherein said seat portion, said back portion and said support members are integrally formed as a single molded piece of material.

17. The invention of claim 16 wherein said hollows extend continuously upward from the support members into internal side regions of the back portion.

18. The invention of claim 17 wherein said hollows extend continuously from the support members inwardly along a rear internal region of the seat portion.

19. The invention of claim 17 wherein said hollows extend across the entire width of the rear region of the seat portion such that a single continuous enclosed hollow is formed internally in the seating structure.

20. The invention of claim 19 wherein said hollow extends forwardly from said rear internal region of said seat portion so as to allow for a fastener to extend therein for securely attaching the seating structure to a support structure.

21. The invention of claim 16 wherein said hollow runs continuously along substantially the entire length of said support member.

22. The invention of claim 16 wherein the seating structure is made of an injection molded polymeric material, and the enclosed hollow is formed internally in the seating structure by injecting a low pressure heat-activated gas in the polymeric material.

23. The invention of claim 16 wherein the support members comprise armrests defined by a first leg extending forwardly from the back portion and a second leg extending upwardly from the seat portion, said enclosed hollow extending continuously internally from said second leg to said first leg.

24. The invention of claim 23 wherein the second legs of the armrests extend upwardly from opposite side rear corner portions of the seat portion.

25. The invention of claim 24 wherein the second legs of the armrest are curved.

26. The invention of claim 23 further comprising cushions attached to the armrests.

27. The invention of claim 16 wherein a lower edge of the back portion is spaced apart from a rear edge of the seat portion so as to form an opening between them.

28. The invention of claim 27 further comprising a resilient spring portion interconnecting the rear edge of the seat portion to the lower edge of the back portion.

29. The invention of claim 28 wherein the width of the spring portion is narrower than the width of the seat portion and the back portion.

30. The invention of claim 16 further comprising cushions attached to the seat and back portions.

* * * * *

UNITED STATES PATENT AND TRADEMARK OFFICE

CERTIFICATE OF CORRECTION

PATENT NO. : 5,810,438
DATED : September 22, 1998
INVENTOR(S) : Thomas J. Newhouse It is certified that error appears in the above-identified patent and that said Letters Patent is hereby corrected as shown below:

Title page,
Column 1,
After line 21, under "U.S. PATENT DOCUMENTS", please insert the following:

-- 4,157,203 6/1979 Ambasz 297/286 --.

Column 2,
After line 21, please insert the following:

-- 5,478,137 12/1995 Olson et al. 297/227 --.

Column 5,
Line 45, please delete underline and move the following lines up.

Claim 19,
Line 1, please change "17" to -- 18 --.

Signed and Sealed this

Twenty-first Day of August, 2001

*Attest:*

Nicholas P. Godici

NICHOLAS P. GODICI
*Acting Director of the United States Patent and Trademark Office*

*Attesting Officer*